US008800338B2

(12) United States Patent
Whitworth

(10) Patent No.: US 8,800,338 B2
(45) Date of Patent: Aug. 12, 2014

(54) MANUFACTURE OF COIL SPRINGS

(75) Inventor: Ian James Whitworth, Nottinghamshire (GB)

(73) Assignee: Springform Technology Limited, Leicestershire (GB)

( * ) Notice: Subject to any disclaimer, the term of this patent is extended or adjusted under 35 U.S.C. 154(b) by 267 days.

(21) Appl. No.: 13/140,461

(22) PCT Filed: Dec. 15, 2009

(86) PCT No.: PCT/GB2009/051715

§ 371 (c)(1),
(2), (4) Date: Jun. 17, 2011

(87) PCT Pub. No.: WO2010/070334

PCT Pub. Date: Jun. 24, 2010

(65) Prior Publication Data

US 2011/0247383 A1 Oct. 13, 2011

(30) Foreign Application Priority Data

Dec. 18, 2008 (GB) ..... 0823067.4

(51) Int. Cl.

| | |
|---|---|
| ***B21F 33/04*** | (2006.01) |
| ***B21K 21/00*** | (2006.01) |
| ***C21D 9/54*** | (2006.01) |
| ***B21F 3/02*** | (2006.01) |
| ***C21D 9/02*** | (2006.01) |
| ***C21D 9/06*** | (2006.01) |
| ***B68G 9/00*** | (2006.01) |
| ***B21F 99/00*** | (2009.01) |
| ***C21D 1/40*** | (2006.01) |
| ***C21D 9/62*** | (2006.01) |

(52) U.S. Cl.

CPC ... *B21F 3/02* (2013.01); *C21D 9/54* (2013.01); *B21F 33/04* (2013.01); *C21D 9/02* (2013.01); *C21D 9/06* (2013.01); *B68G 9/00* (2013.01); *B21F 99/00* (2013.01); *C21D 1/40* (2013.01); *C21D 9/62* (2013.01)

USPC ..... 72/128; 72/54; 72/135; 29/896.92; 140/3 CA; 140/92.7

(58) Field of Classification Search

USPC ..... 72/54, 128, 135, 137; 29/91, 896.92; 140/3 CA, 92.7

See application file for complete search history.

(56) References Cited

U.S. PATENT DOCUMENTS 3,552,168 A 1/1971 Svensson et al.
4,111,241 A * 9/1978 Crown ..... 72/137

(Continued)

FOREIGN PATENT DOCUMENTS

DE 3620148 A1 3/1987
EP 0155158 A2 9/1985

(Continued)

OTHER PUBLICATIONS

Notification Concerning Transmittal and International Preliminary Report on Patentability dated Jun. 30, 2011, from the corresponding International Application No. PCT/GB2009/051715 filed Dec. 15, 2009.

(Continued)

*Primary Examiner* — David B Jones
(74) *Attorney, Agent, or Firm* — Young Basile

(57) ABSTRACT

An apparatus is disclosed for the manufacture of a coil spring from a wire. The apparatus comprises first and second tools for contacting the wire prior to, and/or during, deformation of the wire into a coil spring. The apparatus includes means for applying an electrical potential difference between the first and second tools such that an electric current is caused to flow through at least part of the wire during use.

25 Claims, 3 Drawing Sheets

(56) References Cited

U.S. PATENT DOCUMENTS

| | | | | |
|---|---|---|---|---|
| 4,115,685 | A * | 9/1978 | Grandin et al. | 219/155 |
| 4,705,580 | A | 11/1987 | Yamazaki | |
| 5,016,305 | A | 5/1991 | Suenens et al. | |
| 5,792,309 | A | 8/1998 | Eto | |
| 6,143,122 | A | 11/2000 | Mossbeck et al. | |
| 6,159,319 | A | 12/2000 | Mossbeck | |
| 6,176,960 | B1 | 1/2001 | Mossbeck et al. | |
| 6,408,514 | B1 * | 6/2002 | Mossbeck et al. | 29/896.92 |
| 6,922,895 | B1 | 8/2005 | Whitworth | |
| 7,211,167 | B1 | 5/2007 | Whitworth | |

FOREIGN PATENT DOCUMENTS

| | | | |
|---|---|---|---|
| EP | 0154076 | B1 | 4/1990 |
| EP | 0421495 | A1 | 4/1991 |
| EP | 0624545 | A1 | 11/1994 |
| EP | 1068147 | B1 | 8/2003 |
| EP | 1163188 | B1 | 10/2004 |
| WO | 9607345 | A1 | 3/1996 |
| WO | 9737569 | A1 | 10/1997 |
| WO | 0015380 | A1 | 3/2000 |
| WO | 0055088 | A1 | 9/2000 |
| WO | 0238304 | A1 | 5/2002 |

OTHER PUBLICATIONS

UK Search Report dated Oct. 26, 2011 from corresponding Application GB1107396.2.

International Search Report dated Aug. 1, 2012 from corresponding Application No. PCT/GB2012/050977 filed May 4, 2012.

* cited by examiner

MANUFACTURE OF COIL SPRINGS

CROSS REFERENCE TO RELATED APPLICATION

This application claims priority from United Kingdom patent number UK 0823067.4 filed Dec. 18, 2008, incorporated herein by reference in its entirety.

TECHNICAL FIELD

This invention relates to apparatus for the manufacture of coil springs, and in particular pocketed coil springs.

BACKGROUND

Pocketed coil springs, i.e. coil springs enclosed within pockets of fabric which are joined at their side seams, are widely used in the manufacture of mattresses, cushions and the like. Apparatus for the production of pocketed coil springs generally comprises a coiling assembly in which a coil spring is formed from wire, and an encapsulation assembly in which the coil spring is encapsulated within a pocket. In particular, the coil spring is generally formed in the coiling assembly, and then fed directly to the encapsulation assembly in which the coil spring is inserted between two sheets of a weldable fabric, the two sheets then being sealed together to form a pocket which encapsulates the spring. The fabric is then indexed forward, the next spring encapsulated, and so on. In this way, lengthy strings of pocketed coil springs may be built up.

It is sometimes desirable to heat-treat the coil springs before they are encapsulated within pockets of fabric. This is because coil springs that have been heat-treated tend to have a reduced loss of height over prolonged periods of use, ie increased resistance to metal fatigue, and tend to be firmer, and in particular more resilient, than coil springs that have not been heat-treated.

However, conventional methods of manufacturing pocketed coil springs that include a heat treatment step suffer from numerous disadvantages. In particular, each coil spring is typically clamped at each end by an electrode, and then heated to approximately 250° C. by resistive heating. This heat treatment step is often the slowest step in the manufacturing process, and hence manufacture is slowed down significantly by the inclusion of a heat treatment step. Furthermore, it is generally necessary to clamp shaped electrodes to each end of the spring, and the electrodes generally need to be adjusted when coil springs are to be manufactured with a new spring geometry. This significantly increases the time taken to change the geometry of the coil springs.

SUMMARY

There has now been devised an improved apparatus for the manufacture of coil springs, and an improved method of manufacturing coil springs, which overcome or substantially mitigate the above-mentioned and/or other disadvantages associated with the prior art.

According to a first aspect of the invention, there is provided apparatus for the manufacture of a coil spring from a wire, the apparatus comprising first and second tools for contacting the wire prior to, and/or during, deformation of the wire into a coil spring, wherein the apparatus includes means for applying an electrical potential difference between the first and second tools, such that an electric current is caused to flow through at least part of the wire, during use.

According to a further aspect of the invention, there is provided a method of manufacturing coil springs from a wire, which method comprises the steps of:

(a) providing apparatus as described above;

(b) applying an electrical potential difference between the first and second tools, such that an electric current is caused to flow through at least part of the wire, and (c) forming a coil spring from the wire.

The apparatus and method according to the invention are advantageous principally because they enable at least part of the wire to be heated, during use, without any need for an additional heat-treatment station of the apparatus. There is also no need for the coil spring to be clamped by electrodes before heat-treatment, and hence the speed of manufacture may be increased and different geometries of coil spring may be manufactured without any need for manual adjustment of the apparatus. Furthermore, as discussed in more detail below, the apparatus and method according to the invention enable the coil springs to be heat-treated in a more precise and controllable manner than the prior art methods discussed above.

The first and second tools, between which an electrical potential is applied, could conceivably be any of the tools of the apparatus that contact the wire prior to, and/or during, deformation of the wire into a coil spring. In particular, at least one of the first tool and the second tool may be a tool for moving the wire, or at least one of the first tool and the second tool may be a tool for deforming the wire.

Furthermore, the first and second tools are preferably adapted to have a substantially consistent quality of electrical contact with the wire, and the materials of the first and second tools are preferably selected to reduce arcing between the tool and the wire.

The apparatus is preferably adapted to heat the wire before, or during, deformation of the wire into a coil spring, such that this deformation occurs whilst the wire has an elevated temperature relative to its surroundings. In particular, the wire preferably has a temperature during deformation into a coil spring that is sufficient to improve the resilience and/or the resistance to fatigue of the coil spring, and most preferably to provide the coil spring with desired properties. Indeed, we have found that it is possible to achieve with the present invention at least the same improvement of the properties of the coil spring as that achieved by prior art heat treatment methods, in which the spring is heated following deformation of the wire. Hence, the temperature of the wire during deformation into a coil spring is preferably sufficient to achieve at least the effect of the prior art discussed above.

Where the first and second tools both contact the wire prior to deformation into a coil spring, the heating brought about by these tools is preferably sufficient for the wire to retain an elevated temperature during deformation of the wire into a coil spring. In this arrangement, at least one of the first and second tools is preferably adapted to contact the wire immediately prior to deformation of the wire into a coil spring. This arrangement has been found to produce a coil spring that has improved resilience, relative to coil springs that are heat-treated following deformation of the wire into a coil spring. Hence, according to a further aspect of the invention, there is provided a coil spring manufactured using the apparatus and/or method described above.

Any parts of the apparatus that are in the proximity of the first and/or second tools are preferably at the same electrical potential as the first and/or second tools, either by means a connection to the same source of electrical potential as the first and/or second tools or by that part of the apparatus being electrically isolated from its surroundings, for example its support.

At least one of the first and second tools is preferably a roller. In this arrangement, the roller is preferably adapted to grip the wire between itself and a cooperating roller. The two cooperating rollers are preferably at the same electrical potential as each other, either by means of separate connections to the same source of electrical potential or by one of the rollers being electrically isolated from its support. Furthermore, in order to improve the contact between the roller and the wire, the cooperating rollers are preferably adapted to be urged together, thereby applying force to either side of the wire gripped therebetween.

Each of the first and second tools is preferably adapted for connection to either the terminal of a power supply, or a separate connection to electrical earth. The apparatus according to the invention preferably therefore includes electrical connections to the first and second tools, which are preferably adapted for the particular form of tool. For example, where the tool is adapted for rotation through more than one revolution, for example a roller, the electrical connection for that tool may include a rotary electrical interface, ie a slip ring, which may have a brush or mercury connection, for example. Alternatively, the electrical connection may include a brush engaged with the surface of the rotating tool, where the brush may be formed of metal fibres or a block of metal or carbon, for example.

As discussed above, the present invention is particularly advantageous because a separate heat-treatment station is not required. In particular, the first and second tools for contacting the wire are preferably tools that are adapted to play a role in formation of the coil spring, by either moving or deforming the wire, but are adapted to cause an electric current to flow through the wire. Indeed, the first and second tools for contacting the wire are preferably tools that are found in conventional coil spring manufacturing apparatus, but adapted to have an electrical potential difference applied thereto.

The apparatus preferably comprises a source of wire, from which one or more coil springs are to be formed. Most preferably, the source of wire is sufficient for the formation of a plurality of coil springs, such that the method of manufacture is a continuous process for the formation of a plurality of coil springs. The source of wire is typically a length of wire wound about a spool or frame, which is generally rotatable to facilitate feeding the wire to a coiling assembly. The wire is typically formed of steel, or a similar metal.

The apparatus preferably comprises a feed assembly that is adapted to feed the wire from the source of wire to a coiling assembly, which forms the coil spring. The feed assembly preferably comprises a mechanism for moving the wire along a feed axis, which typically includes one or more rollers. In presently preferred embodiments, the feed assembly has a pair of cooperating feed rollers adapted to grip a portion of the wire therebetween, such that rotation of the rollers, in opposite rotational directions, causes the wire to be fed to the coiling assembly. The apparatus typically therefore includes a mechanism for rotating the rollers at the desired feed rate. In particular, it is common for the feed rate to be in the range of 1 $ms^{-1}$ to 5 $ms^{-1}$, for example approximately 2 $ms^{-1}$. The apparatus may also include a mechanism for urging the feed rollers together, such as a resilient biasing.

A feed roller is particularly suitable for use as one of the tools between which an electrical potential is applied, i.e. the first or second tool. In particular, a conventional feed roller is typically adapted to have a contact with the wire that would be of sufficient quality to enable the flow of electric current between the roller and the wire. The feed rollers of the present invention may therefore be substantially conventional, but at least one of the feed rollers may include an electrical connection. The electrical connection may be adapted to connect to a source of electrical potential. In addition, the two feed rollers are preferably at the same electrical potential as each other, either by means of separate connections to the same source of electrical potential or by one of the rollers being electrically isolated from its support.

Where the feed assembly includes a guide block for guiding the wire between the feed rollers, this guide block will typically be electrically isolated. However, in some embodiments, the guide block may be suitable for use as one of the tools between which an electrical potential is applied, i.e. the first or second tool. The guide block of those embodiments may therefore include an electrical connection.

The feed assembly may also include rollers for removing deformations, such as kinks, bends and/or torsional imbalance, from the wire, prior to the wire arriving at the coiling assembly. These rollers are typically referred to as "straightening rollers", and are generally disposed between the source of wire and the feed rollers. The straightening rollers are generally arranged in two rows, which typically have at least two rollers in each row, and generally define a non-linear path for the wire between the two rows of rollers. In particular, the two rows of straightening rollers are preferably arranged in a generally hexagonal packed arrangement, but with at least some separation between the rollers. The straightening rollers are preferably rotatable, but do not include means for actively rotating the rollers. Instead, the wire is preferably drawn along the path defined by the straightening rollers, from the source of wire, by the feed rollers.

A straightening roller is particularly suitable for use as one of the tools between which an electrical potential is applied, ie the first or second tool. In particular, a conventional straightening roller is typically adapted to have a contact with the wire that would be of sufficient quality to enable the flow of electric current between the roller and the wire. The straightening rollers of the present invention may therefore be substantially conventional, but at least one of the straightening rollers may include an electrical connection. The electrical connection may be adapted to connect to a source of electrical potential. In addition, all of the straightening rollers are preferably at the same electrical potential as each other, either by means of separate connections to the same source of electrical potential or by some of the rollers being electrically isolated from its support. Nevertheless, the lead straightening roller, ie the final straightening roller before the feed rollers, is preferably electrically isolated from its support. This is because the contact between the lead straightening roller and the wire is typically of lesser quality than the contact between the other straightening rollers and the wire, and hence there may otherwise be a risk of excessive arcing between the lead straightening roller and the wire.

The apparatus preferably comprises a coiling assembly that is adapted to form a coil spring from the wire. In particular, the coil assembly preferably comprises one or more members adapted to deform the wire into a desired shape, ie a coil, in order to form the coil spring. The one or more coil forming members preferably comprise a pitch-defining member (e.g., a so-called "spreader") and a diameter-defining member (e.g., a so-called "finger"), which are typically separate members that are independently controllable. In particular, the pitch-defining member and the diameter-defining member are preferably each movable by a drive mechanism, such as a servo motor, which is preferably controlled using a programmable logic controller, e.g., using CNC control.

At least one of the tools of the coiling assembly, such as the pitch-defining member and/or the diameter-defining member, may also be suitable for use as one of the tools between which an electrical potential is applied, i.e. the first or second tool. In particular, conventional pitch-defining and/or diameter-defining members may be suitable to have a contact with the wire that would be of sufficient quality to enable the flow of electric current between the tool and the wire. Alternatively, a selection of suitable materials may adapt those tools to be suitable for such use. At least one of the tools of the coiling assembly may therefore include an electrical connection. The electrical connection may be adapted to connect to a source of electrical potential.

The coiling assembly will typically also include a cutter, which cuts the wire between each successive spring formed from the wire. In view of the short period of time over which the cutter is in contact with the wire, the cutter is unlikely to be suitable for use as one of the tools between which an electrical potential is applied, i.e. the first or second tool.

The apparatus preferably includes, or is adapted for connection to, an electrical power supply for applying an electrical potential to at least one of the tools between which an electrical potential is applied, ie the first or second tool. The other tool may also be connected to the power supply, or may be directly or indirectly connected to earth. The apparatus preferably also includes an arrangement for controlling the electric current caused to flow through the wire, during use. In particular, the control arrangement preferably includes an electronic switch that either enables, or prevents, flow of current through the wire, and a controller for actuating the electronic switch. In particular, the control arrangement may be adapted to enable flow of current through the wire throughout the period of time that the wire for forming a coil spring is being fed between the first and second tools, or the control arrangement may be adapted to enable flow of current through the wire during a pre-determined portion of that time.

The application of an electrical potential difference between the first and second tools, such that an electric current is caused to flow through at least part of the wire, during use, preferably causes at least that part of the wire through which electric current flows to be heated, ie by resistive heating. In particular, at least that part of the wire through which electric current flows is preferably heated to a temperature that is elevated relative to the ambient temperature. At least that part of the wire through which electric current flows is heated to a temperature that is sufficient for that part of the wire to have a temperature during deformation into a coil spring that is sufficient to improve the resilience and/or the resistance to fatigue of the coil spring, and most preferably to provide at least the same improvement of the properties of the coil spring as that achieved by prior art heat treatment methods, in which the spring is heated following deformation of the wire.

The power supply is preferably selected with a power output, and in particular a current output, sufficient to cause a desired heating of the wire. In order to achieve efficient heating of the wire, the power source is preferably a low voltage, high current supply. In particular, the current output necessary to achieve the desired heating of the wire may be calculated using well known theory regarding the heating of conductors, together with data regarding the electrical resistivity of the wire material, the length and diameter of the wire between the first and second tools, and the period of time over which the electric current will flow through each part of the wire. Nevertheless, the current output necessary to achieve the desired heating of the wire is most conveniently determined by experiment, eg simple trial and error.

As discussed above, the apparatus preferably includes means for controlling the current flow through the wire, which is preferably adapted to determine the properties of the coil spring being formed. In particular, the current flow may be varied in order to vary the heat generated, and hence the temperature of the wire. The current flow applied to the wire for each spring may be constant, or may vary along its length in order to provide different portions of the spring with different properties. In particular, the current flow may be discontinuously applied to the wire for each coil spring, such that only part of the wire that forms each spring is heated. For example, in one embodiment, the end portions of the spring are not heated. In particular, the end portions of the spring typically do not require heat treatment. In addition, the discontinuous application of current flow may reduce the risk of excessive heat build-up in the apparatus. The application of current flow to the wire is preferably controlled using CNC control.

The apparatus and method according to the present invention are particularly advantageous in relation to the manufacture of pocketed coil springs. In this embodiment, the apparatus according to the invention includes an encapsulation assembly in which the coil spring is inserted between juxtaposed sheets of material and in which the sheets of material are joined together to form a pocket that encapsulates the coil spring.

In the encapsulation assembly, each coil spring is preferably fed into the space between two plies of a weldable fabric, the two plies then being sealed together to form a pocket which encapsulates the coil spring. The fabric is preferably then indexed forward, the next spring encapsulated, and so on, so as to form a continuous string of pocketed coil springs. The continuous string of pocketed coil springs may then be severed to form separate strings of pocketed coil springs suitable for forming an innerspring assembly for a mattress, a cushion, or the like. Hence, according to a further aspect of the invention, there is provided an innerspring assembly comprising pocketed coil springs manufactured using the apparatus and/or method described above.

Each string of pocketed coil springs generally comprises a series of fabric pockets, each pocket enclosing a coil spring. The operable axes of the springs are generally all orientated in the same direction, which is preferably orthogonal to the longitudinal axis of the string, and the pockets are generally dimensioned such that the springs are at least partially compressed in a rest configuration of the innerspring assembly. Each pocket is typically therefore generally cylindrical in shape.

Where the coil springs are encapsulated within pockets of a weldable fabric, the apparatus according to the invention preferably includes means for cooling the coil springs. It is generally necessary for the coil springs to be cooled to a temperature of below approximately 100° C. before insertion between two plies of weldable fabric.

Since a gradual cooling of the coil springs is desirable, such that the properties of the springs are not affected by the cooling, the apparatus preferably comprises a mechanism that allows passive cooling of the coil springs, for example by conduction of heat to the surroundings. In presently preferred embodiments, the apparatus includes a conveyor mechanism that transports the coil springs from the coiling assembly to the encapsulation assembly, over a sufficient period of time for the coil springs to be sufficiently cooled for encapsulation within pockets of a weldable fabric.

In particular, the apparatus for the manufacture of coil springs preferably comprises a conveyor adapted to receive a coil spring from a coiling assembly, and then transfer the coil spring to an encapsulation assembly along a conveyor path.

In presently preferred embodiments, the conveyor is adapted to carry a plurality of coil springs along a continuous path, wherein the conveyor is adapted to receive a coil spring from a first coiling assembly, and then transfer the coil spring to an encapsulation assembly along a first portion of the conveyor path, and the conveyor is adapted to receive a coil spring from a second coiling assembly, and then transfer the coil spring to an encapsulation assembly along a second portion of the conveyor path.

This conveyor mechanism is advantageous principally because the conveyor mechanism is adapted to transport coil springs from two separate coiling assemblies, simultaneously. Furthermore, this invention enables substantially the full extent of the continuous path of the conveyor to be utilised for transporting coil springs. In particular, the first and second portions of the conveyor path along which coil springs are transported are preferably separate from each other, most preferably arranged substantially end-to-end.

Hence, according to a further aspect of the invention, there is provided apparatus for the manufacture of pocketed coil springs comprising a coiling assembly for forming a coil spring, a conveyor adapted to carry a plurality of coil springs along a continuous path, and an encapsulation assembly in which the coil springs are inserted between juxtaposed sheets of material and in which the sheets of material are joined together to form a pockets that encapsulate the coil springs, wherein the conveyor is adapted to receive a coil spring from a first coiling assembly, and then transfer the coil spring to an encapsulation assembly along a first portion of the conveyor path, and the conveyor is adapted to receive a coil spring from a second coiling assembly, and then transfer the coil spring to an encapsulation assembly along a second portion of the conveyor path.

In presently preferred embodiments, the conveyor comprises a continuous support, ie a belt, which is preferably driven by a rotatable drive member, such as a drive pulley or a drive sprocket, at one end of the conveyor. In this arrangement, the conveyor support is preferably supported at its other end by a rotatable support member, such as a pulley or a sprocket.

The conveyor preferably includes a plurality of retainers mounted on the support, each adapted to retain a coil spring. The retainers are preferably arranged along the entire length of the support, and are preferably substantially regularly spaced along the length of the support. Each retainer conveniently takes the form of a container adapted to hold a single coil spring. Each container preferably includes an opening through which the coil spring is received, and an opening through which the coil spring exits the container, which may be separate, for example at opposite ends of the container. The openings may include an openable closure adapted to retain the coil spring within the container during transportation between the coiling assembly and the encapsulation assembly. Alternatively, the conveyor may be adapted to move relative to one or more closure elements, which are arranged to retain the coil springs within the containers during transportation between the coiling assembly and the encapsulation assembly.

The first and second portions of the conveyor path along which coil springs are transported are preferably distinct paths, which do not overlap. In particular, the first and second portions of the conveyor path along which coil springs are transported are most preferably arranged substantially end-to-end. Where the conveyor is adapted to cooperate with two coiling assemblies, the first and second portions of the conveyor path along which coil springs are transported are preferably arranged to extend along substantially the entire extent of the conveyor path. In particular, the first and second portions of the conveyor path are preferably arranged to extend along two halves of the conveyor path. The conveyor may also be adapted to receive coil springs from further coiling assemblies, and then transfer the coil springs to an encapsulation assembly along further portions of the conveyor path. Nevertheless, the portions of the conveyor path along which coil springs are transported are preferably arranged to extend along substantially the entire extent of the conveyor path, and will typically be substantially equal in length.

In presently preferred embodiments, the apparatus is adapted to deliver coil springs, from both the first coiling assembly and the second coiling assembly, to the encapsulation assembly, substantially simultaneously. This is most conveniently achieved by the transfer paths followed by the coil springs, from the conveyor to the encapsulation assembly, being the same length. For this reason, the transfer paths from the conveyor to the encapsulation assembly will typically originate from parts of the conveyor that are at the same height.

The apparatus may also include means for actively cooling the coil springs. For example, the apparatus may include a fan for blowing cool air towards the coil springs.

In the encapsulation assembly, each coil spring is preferably fed into the space between two plies of a weldable fabric, the two plies then being sealed together to form a pocket which encapsulates the coil spring. In particular, a particularly suitable encapsulation assembly is described in European Patent No 1068147.

Nevertheless, since the conveyor described above enables two coil springs to be delivered to the encapsulation assembly substantially simultaneously, the encapsulation assembly of this invention is preferably adapted to encapsulate two coil springs within respective pockets, substantially simultaneously. In particular, the encapsulation assembly is preferably adapted to feed two coil springs substantially simultaneously into the space between two plies of material, eg fabric, the two plies then being sealed together to form two pockets, which each encapsulate a coil spring. The two plies of material are preferably formed by a sheet of weldable fabric, which is folded about a longitudinal axis. In this arrangement, the two pockets are preferably formed by applying two cross welds, and an end weld that extends along both pockets.

The encapsulation assembly is preferably adapted to then index the material forward a distance equal to two pockets, the next two springs encapsulated, and so on, so as to form a continuous string of pocketed coil springs. The continuous string of pocketed coil springs may then be severed to form separate strings of pocketed coil springs suitable for forming an innerspring assembly for a mattress, a cushion, or the like.

DETAILED DESCRIPTION OF THE DRAWINGS

Preferred embodiments of the invention will now be described in greater detail, by way of illustration only, with reference to the accompanying drawings, in which.

DETAILED DESCRIPTION OF EMBODIMENTS

Figure 1:
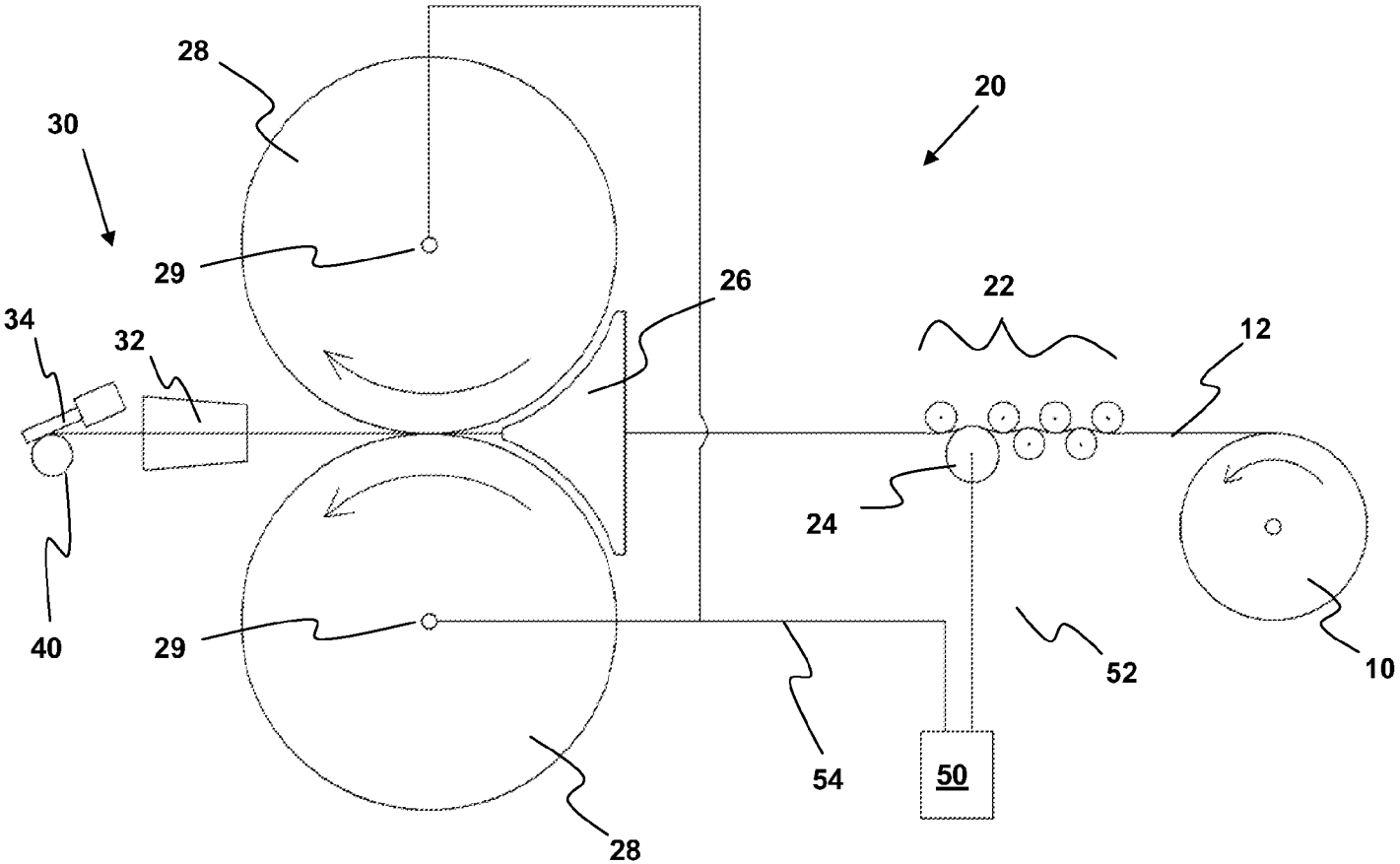
FIG. 1 is a schematic side view of a first embodiment of apparatus according to the invention.

FIG. 1 shows a first embodiment of apparatus according to the invention comprising a feed assembly 20 and a coiling assembly 30, which are together adapted to form coil springs 40. In particular, the feed assembly 20 feeds a continuous wire 12 from a wire roll 10 to the coiling assembly 30, where the wire 12 is deformed into a coil and then severed from the remainder of the wire 12, in order to form a coil spring 40.

The wire roll 10 comprises a rotatable spool, on which is wound a continuous metal wire 12. This wire is formed of steel, having a diameter in the range of 0.5 mm to 3.0 mm. From the wire roll, the wire 12 is fed through a set of straightening rollers 22, a guide block 26 and a pair of feed rollers 28.

The straightening rollers 22 are arranged in two rows, which define a non-linear path for the wire 12 therebetween. In particular, the straightening rollers 22 are arranged in a hexagonal packed arrangement, but with sufficient separation between the rollers 22 for the wire 12 to be only slightly deflected from a central axis. The straightening rollers 22 are adapted to remove kinks and bends from the wire 12, before the wire 12 reaches the coiling assembly 30.

Of the seven straightening rollers 22 shown in FIG. 1, the electrode roller 24 is the straightening roller 22 disposed immediately before the lead roller 22, the lead roller 22 being the straightening roller 22 that is closest to the feed rollers 28. The electrode roller 24 has a greater diameter than the remainder of the straightening rollers 22, in order to increase the area of contact between the electrode roller 24 and the wire 12.

The electrode roller 24 is connected to a positive terminal (V+) of a power supply 50 by an electrical connection 52. In particular, the electrode roller 24 is formed of an electrically-conductive material, such as steel, and is connected through one or more mercury-filled slip rings to the power supply 50. The remaining straightening rollers 22, including the lead roller 22, are electrically isolated. In particular, the isolated straightening rollers 22 are rotatably mounted using bearings formed of insulating material.

The guide block 26 includes an open-ended passageway through which the wire 12 extends, and which guides the wire 12 between the pair of feed rollers 28. The guide block 26 is mounted upon a support of insulating material, and hence is electrically isolated.

The feed rollers 28 grip the wire 12 therebetween and are adapted to be actively rotated in opposite directions, in order to feed the wire 12 to the coiling assembly 30. In particular, a drive mechanism (not shown in the Figures) is provided that rotates the feed rollers 28, and the feed rollers 28 are adapted to draw wire from the wire roll 10, through the set of straightening rollers 22, to the coiling assembly 30. During use, the feed rollers 28 are rotated at a rate appropriate to feed the wire 12 through the apparatus at a substantially constant rate of approximately 2 to 3 $ms^{-1}$. In addition, the feed rollers 28 are resiliently biased towards each other, in order to facilitate engagement with the wire 12.

Each feed roller 28 is formed of steel, and is rotatably mounted about a central axle 29. The feed rollers 28 are each connected to the negative terminal (0V) of the power supply 50 through an electrical connection 54 with the central axles 29. In particular, the central axles 29 connect the feed rollers 28 to the negative terminal (0V) of the power supply 50.

The coiling assembly 30 comprises a pitch-defining tool 32, having the form of a so-called "spreader", and a diameter-defining tool 34, having the form of a so-called "finger". These tools 32, 34 are connected to servo mechanisms, and are adapted to move in response to instructions provided by a programmable logic controller using CNC control. The movement of these tools 32, 34 determine the shape of the coil springs 40 being formed.

A cutter (not shown in the Figures) is also provided that severs a completed coil spring 40 from the remainder of the wire 12. The apparatus according to the invention is therefore adapted to form a large number of coil springs 40 in a continuous process.

The power supply is a 15V power supply, which is adapted to provide a current of approximately 200 A through the part of the wire 12 that extends between the straightening rollers 22 and the feed rollers 28. The power supply 50 is controlled by a computer, such that a desired amount of heat is generated within the wire 12. In particular, this computer control is adapted to heat the wire to a desired temperature, before the wire 12 is fed to the coiling assembly 30. Indeed, the apparatus is adapted so that the wire 12 retains an elevated temperature during coiling in the coiling assembly 30, which is sufficient to achieve the desired improvement in the properties of the coil springs produced. The appropriate amount of heating is most conveniently determined by simple trial and error.

In this embodiment, the power supply 50 is not connected to the straightening rollers 22 and the feed rollers 28 continuously. In particular, the apparatus is adapted to apply electric current to the wire 12 in pulses, such that those parts of the wire 12 that form end portions of the coil springs 40 are not heated prior to being fed to the coiling assembly 30. In particular, heat-treatment is not necessary for the end portions of a coil spring, and this pulsed delivery of electric current ensures that excessive heat does not build-up within the apparatus.

Figure 2:
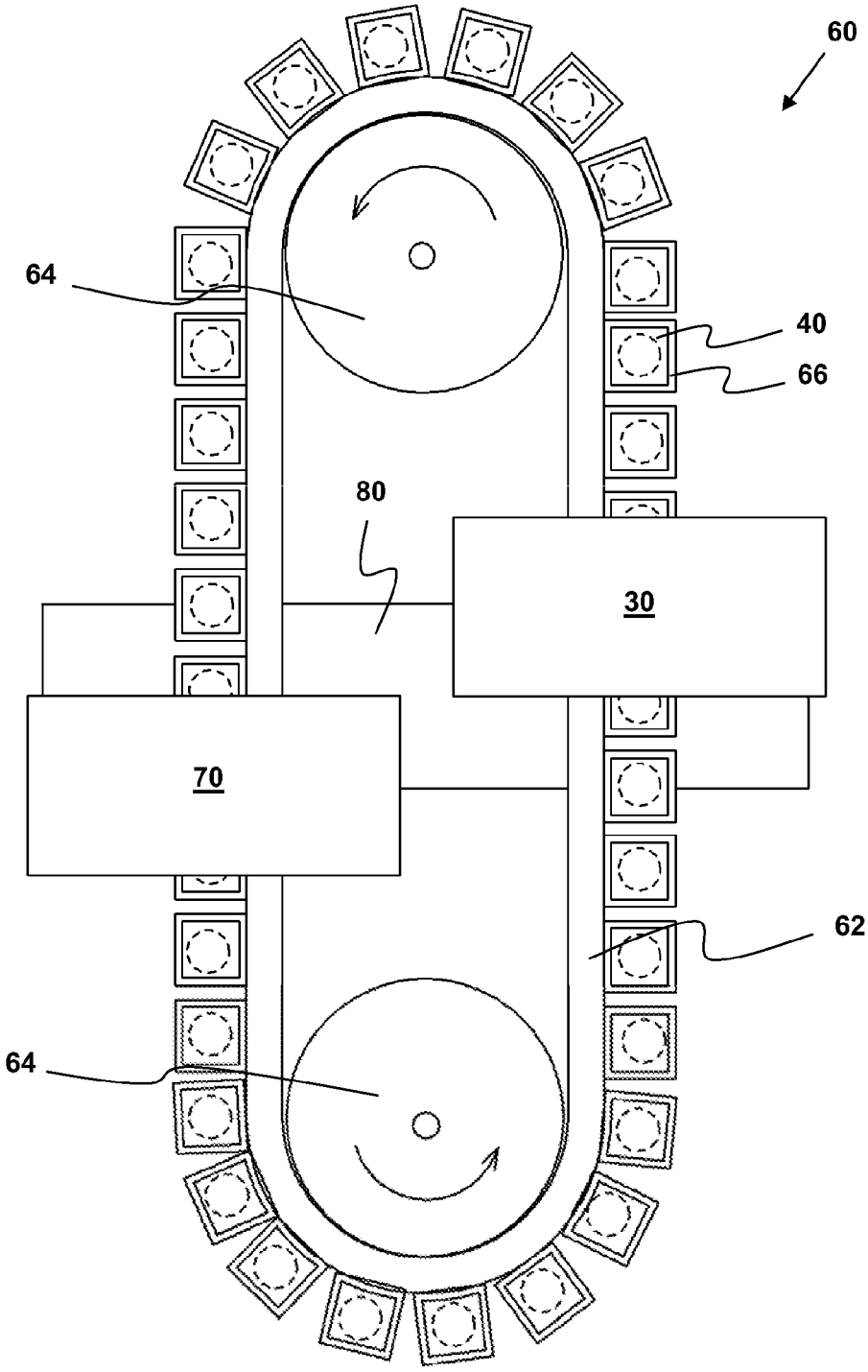
FIG. 2 is a schematic side view of a second embodiment of apparatus according to the invention.

FIGS. 2 and 3 shows a second embodiment of apparatus according to the invention, which is specifically adapted to form pocketed coil springs. This apparatus comprises a feed assembly and coiling assembly 30 as described above in relation to the first embodiment. In addition, however, the second embodiment comprises a conveyor mechanism 60, a second feed assembly and coiling assembly 70, and an encapsulation assembly 80.

The conveyor assembly 60 comprises a conveyor belt 62, which is continuous and extends about a pair of conveyor pulleys 64. The conveyor pulleys 62 are both rotatable, and one of the pulleys 62 is rotated by a drive mechanism, which causes the belt 62 to travel along a continuous path about the pulleys 62. The conveyor assembly 60 also includes a series of containers 66 that are mounted to the exterior surface of the conveyor belt 62. These containers 66 are each adapted to hold a single coil spring 40, and are regularly spaced along the length of the conveyor belt 62. The containers 66 are orientated perpendicularly to the direction of movement of the belt 62, and are adapted to enable the entry of a spring 40 through one end of the container 66 and the exit of a spring 40 through the other end of the container 66.

As shown in FIG. 2, the two feed and coiling assemblies 30,70 are arranged on the same side of the conveyor mechanism 60, with the first feed and coiling assembly 30 situated slightly above the midpoint of one leg of the conveyor path, and the second feed and coiling assembly 30 situated slightly below the midpoint of the other leg of the conveyor path. The two feed and coiling assemblies 30,70 are therefore separated by one half of the conveyor path. The encapsulation assembly 80 is arranged on the other side of the conveyor mechanism 60, with its two entry points aligned with the midpoints of the two legs of the conveyor path.

FIGS. 3*a*-3*d* shows four stages of the conveyor mechanism 60, in use, in which a spring 40 is transferred from the first feed and coiling assembly 30 to the encapsulation assembly 80, and a spring 40 is transferred from the second feed and coiling assembly 70 to the encapsulation assembly 80. For clarity, only one container 66 is shown in these Figures.

Figure 3A:
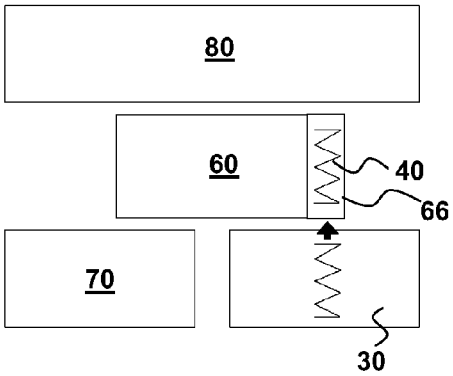
FIG. 3 is a schematic plan view of the second embodiment, in which four stages of use are illustrated.
Figure 3B:
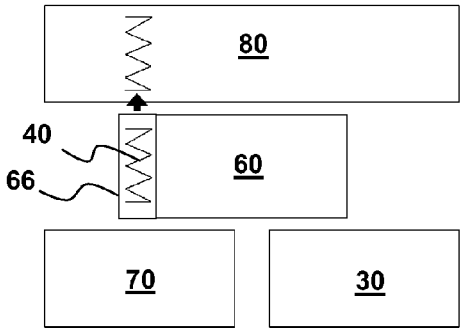

In FIG. 3*a*, the container 66 is aligned with the exit of the first feed and coiling assembly 30, and a first spring 40 is transferred into the container 66. The conveyor mechanism 60 then moves the container 66 approximately half way around the conveyor path, until the container 66 is in alignment with a first entry into the encapsulation assembly 80. As shown in FIG. 3*b*, the first spring 40 is then transferred to the encapsulation assembly 80.

Figure 3C:
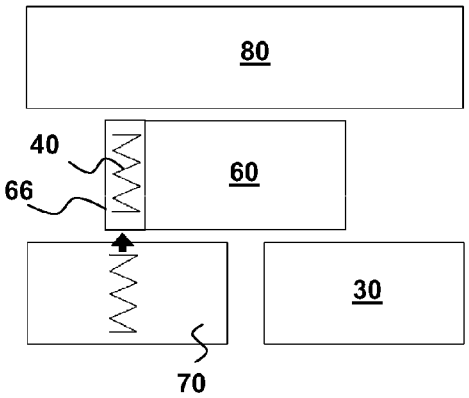
Figure 3D:
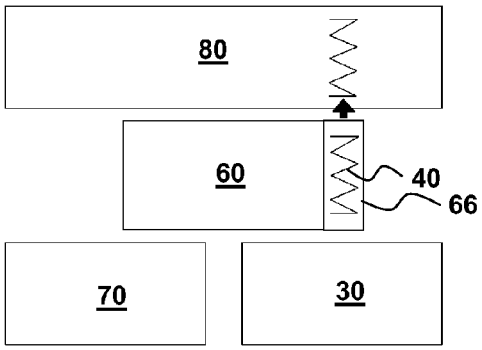

The conveyor mechanism 60 then moves the container 66 a small distance around the conveyor path, until the container 66 is in alignment with the exit of the second feed and coiling assembly 70. As shown in FIG. 3*c*, a second spring 40 is then transferred into the container 66. The conveyor mechanism 60 then moves the container 66 approximately half way around the conveyor path, until the container 66 is in alignment with a second entry into the encapsulation assembly 80. As shown in FIG. 3*d*, the first spring 40 is then transferred to the encapsulation assembly 80.

The conveyor mechanism 60 then moves the container 66 a small distance around the conveyor path, until the container 66 is in alignment with the exit of the first feed and coiling assembly 70. The cycle then re-commences with a spring 40 being transferred into the container 66, as shown in FIG. 3*a*.

The conveyor mechanism 60 of this embodiment is adapted to enable the coil springs 40 formed by the first and second coiling assemblies 30,70 to cool sufficiently to be suitable for encapsulation within pockets of weldable fabric, within the encapsulation assembly 80.

Within the encapsulation assembly 80, each string of pocketed coil springs is manufactured using generally conventional manufacturing techniques and apparatus. For example, a particularly suitable method and apparatus is described in European Patent No 1068147, in which each string is manufactured by feeding a coil spring 40 into the space between two plies of a weldable fabric, the two plies then being sealed together to form a pocket which encapsulates the spring 40. The fabric is then indexed forward, the next spring 40 encapsulated, and so on.

Nevertheless, since the conveyor mechanism 60 of the second embodiment enables two springs 40 to be delivered to the encapsulation assembly 80 substantially simultaneously, the encapsulation assembly 80 of this embodiment is adapted to encapsulate two coil springs within respective pockets, substantially simultaneously. In particular, the encapsulation assembly 80 is adapted to feed two coil springs 40 simultaneously into the space between two plies of a weldable fabric, the two plies then being sealed together (using two cross welds and a double-length end weld) to form two pockets, which each encapsulate a coil spring 40. The fabric is then indexed forward a distance equal to two pocket widths, the next two springs 40 encapsulated, and so on.

The continuous chain of pocketed coil springs is then fed into apparatus for forming strings and fastening those strings together with adhesive. Conventional apparatus may be used for this process. However, particularly suitable apparatus is described in European Patent No 1163188.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. Apparatus for the manufacture of a coil spring from a wire, the apparatus comprising:

first and second tools each configured to contact the wire simultaneously at different locations on the wire prior to deformation of the wire into a coil spring by a coil assembly, at least one of the first and second tools configured to move the wire and at least one of the first and second tools configured to deform the wire, wherein the apparatus includes means for applying an electrical potential difference between the first and second tools, such that an electric current is caused to flow through at least part of the wire, during use.

2. Apparatus as claimed in claim 1, wherein the first and second tools are adapted to have a substantially consistent quality of electrical contact with the wire.

3. Apparatus as claimed in claim 1, wherein heating brought about by the first and second tools is sufficient for the wire to retain an elevated temperature during deformation of the wire into a coil spring.

4. Apparatus as claimed in claim 3, wherein the wire has a temperature during deformation into the coil spring that is sufficient to improve one or both of the resilience and resistance to fatigue of the coil spring.

5. Apparatus as claimed in claim 3, wherein at least one of the first and second tools is adapted to contact the wire immediately prior to formation of the coil spring.

6. Apparatus as claimed in claim 1 further comprising parts that are in proximity of one or both of the first and second tools, wherein the parts are at a same electrical potential as the one or both of the first and second tools.

7. Apparatus as claimed in claim 1, wherein at least one of the first and second tools is a roller.

8. Apparatus as claimed in claim 7, wherein the roller is adapted to grip the wire between itself and a cooperating roller.

9. Apparatus as claimed in claim 8, wherein the roller and the cooperating roller are at a same electrical potential as each other.

10. Apparatus as claimed in claim 1 further comprising electrical connections connecting to the first and second tools.

11. Apparatus as claimed in claim 1, wherein the first and second tools are connected to a power supply configured to heat a part of the wire extending between the first and second tools.

12. Apparatus as claimed in claim 1 further comprising a feed assembly that is adapted to feed the wire from a source of wire to a coiling assembly, which forms the coil spring.

13. Apparatus as claimed in claim 12, wherein the at least one of the first and second tools configured to move the wire comprises a pair of cooperating feed rollers adapted to grip a portion of the wire therebetween, such that rotation of the rollers, in opposite rotational directions, causes the wire to be fed to the coiling assembly.

14. Apparatus as claimed in claim 13, wherein at least one of the feed rollers includes an electrical connection.

15. Apparatus as claimed in claim 1, wherein the at least one of the first and second tools configured to deform the wire comprises straightening rollers configured to remove deformations from the wire, prior to the wire arriving at a coiling assembly, which forms the coil spring.

16. Apparatus as claimed in claim 15, wherein at least one of the straightening rollers includes an electrical connection.

17. Apparatus as claimed in claim 1, wherein the apparatus is configured to connect to an electrical power supply for applying an electrical potential to at least one of the first or second tools.

18. Apparatus as claimed in claim 17, wherein the apparatus includes a control arrangement configured to control the electric current caused to flow through the wire, during use.

19. Apparatus as claimed in claim 18, wherein the control arrangement includes an electronic switch configured to enable and prevent flow of current through the wire, and a controller for actuating the electronic switch.

20. Apparatus as claimed in claim 18, wherein the control arrangement is adapted to vary the electric current in order to vary heat generated, and hence the temperature of the wire.

21. Apparatus as claimed in claim 20, wherein the electric current caused to flow through at least part of the wire is applied to a length of the wire for each spring, and the applied electric current varies along the length of the wire in order to provide different portions of the spring with different properties.

22. Apparatus as claimed in claim 1, wherein the apparatus is adapted to manufacture pocketed coil springs, the apparatus including an encapsulation assembly in which the coil spring is inserted between juxtaposed sheets of material and in which the sheets of material are joined together to form a pocket that encapsulates the coil spring.

23. Apparatus as claimed in claim 22 further comprising a conveyor mechanism configured to transport the coil springs from a coiling assembly to the encapsulation assembly, over a sufficient period of time for the coil springs to be sufficiently cooled for encapsulation within pockets of a weldable fabric.

24. Apparatus as claimed in claim 22 further comprising a conveyor adapted to carry a plurality of coil springs along a continuous path, wherein the conveyor is adapted to receive a coil spring from a first coiling assembly, and then transfer the coil spring to the encapsulation assembly along a first portion of the conveyor path, and the conveyor is adapted to receive a coil spring from a second coiling assembly, and then transfer the coil spring to an encapsulation assembly along a second portion of the conveyor path.

25. A method of manufacturing a coil spring from a wire, which method comprises the steps of:

(a) providing apparatus as claimed in claim 1;

(b) applying an electrical potential difference between the first and second tools, such that an electric current is caused to flow through at least part of the wire, and (c) forming a coil spring from the wire.

* * * * *